8-108.1 SR
F6966 XR 4,576,609

United States Patent [19]
Hageman et al.

[11] Patent Number: 4,576,609
[45] Date of Patent: Mar. 18, 1986

[54] PROCESS FOR THE TREATMENT OF CELLULOSIC MATERIALS WITH OXIDIZING AGENTS AND MICROWAVES

[75] Inventors: Jacques Hageman, Corbais; Lucien Plumet, Vilvoorde; Marcel Robberechts, Beersel, all of Belgium

[73] Assignee: INTEROX (Societe Anonyme), Brussels, Belgium

[21] Appl. No.: 650,066

[22] Filed: Sep. 13, 1984

[30] Foreign Application Priority Data

Sep. 16, 1983 [FR] France ..... 83 14900

[51] Int. Cl.[4] ..... D06L 3/04
[52] U.S. Cl. ..... 8/103; 8/107; 8/108 R; 8/109; 8/111; 8/115.52; 8/444; 8/116.1
[58] Field of Search ..... 8/103, 107, 115.52

[56] References Cited

U.S. PATENT DOCUMENTS 3,695,825 10/1972 Greguss et al. ..... 8/137
3,817,701 6/1974 Thorsen ..... 8/115.52

FOREIGN PATENT DOCUMENTS 796932 6/1958 United Kingdom .

*Primary Examiner*—A. Lionel Clingman
*Attorney, Agent, or Firm*—Spencer & Frank

[57] ABSTRACT

Cellulosic materials and more particularly wood shavings, pulps, and cellulosic textile fibres are exposed to the combined action of microwaves and at least one oxidizing agent.

In particular, the process makes it possible to improve the brightness of the end product.

11 Claims, No Drawings

PROCESS FOR THE TREATMENT OF CELLULOSIC MATERIALS WITH OXIDIZING AGENTS AND MICROWAVES

The present invention relates to a process for the treatment of cellulosic materials and more particularly of pulps, wood shavings and cellulosic textile fibres with oxidising agents.

Cellulosic materials intended for the production of pulps undergo a large number of treatments, some of which are carried out in the presence of oxidising agents especially with a view to improving their brightness or reducing their lignin content. The processes known hitherto do not, however, make it possible to obtain very high brightness gains or very extensive delignification in a single treatment. Consequently, frequent use is made of sequential treatments which generally comprise a very large number of stages. Moreover, each particular stage often lasts a very long time.

Similarly, cellulosic fibres intended for textile applications also undergo certain treatments which can be carried out in the presence of oxidising agents such as bleaching, scouring to remove the impurities, mercerizing to improve their appearance and strength and to reduce the tendency to shrinkage, or steaming to impregnate them with reagents before aging. All these techniques require fairly long treatment times.

The object of the present invention is to provide a process for the treatment of cellulosic materials with oxidising agents which makes it possible to increase the efficiency of the oxidising agent and especially to improve the brightness of the end product. The process according to the invention also makes it possible to reduce appreciably the length of the treatment with the oxidising agent. The process according to the invention also makes it possible to use markedly less solvent than the known processes, which simplifies the subsequent drying stages and reduces effluent waste and solvent consumption. Finally, the process according to the invention makes it possible to reduce or even dispense with any mechanical agitation in the treatments which used to require it. This is the case especially with the treatment of textile fibres and the manufactured products derived therefrom. It is thus possible to avoid the adverse effects of mechanical agitation on delicate textiles such as jerseys, tulles, etc.

The present invention relates to a process for the treatment of cellulosic materials with oxidising agents according to which the cellulosic materials are exposed to the combined action of microwaves and at least one oxidising agent.

Microwaves are electromagnetic waves which have a wavelength of about 0.1 to about 100 cm, i.e. a frequency of about 300,000 to about 300 MHz. Good results have been obtained with microwaves with a frequency of 100,000 to 500 MHz.

Various oxidising agents can be used. Generally, they are chosen from peroxide compounds, oxygen, ozone, permanganate and compounds capable of liberating active chlorine such as molecular chlorine, chlorine dioxide, hypochlorous acid, hypochlorites, chlorites and organic substances capable of liberating active chlorine. Peroxide compounds and compounds capable of liberating active chlorine are suitable. Good results have been obtained with peroxide compounds. The peroxide compounds can be chosen from hydrogen peroxide, metal peroxides and, more particularly, alkali metal peroxides or alkaline earth metal peroxides such as sodium peroxide, inorganic persalts such as perborates, percarbonates and persulphates, inorganic peracids such as persulphuric acid, organic peracids and, more particularly, those containing 2 to 7 carbon atoms such as peracetic acid and perpropionic acid and salts thereof and organic hydroperoxides and peroxides. Good results have been obtained with hydrogen peroxide, sodium peroxide, persulphuric acid, persulphates such as sodium persulphate, peracetic acid and peracetates such as sodium peracetate. The best results were obtained with hydrogen peroxide. One or more oxidising agents of the same type or of different types can be used.

The quantities of oxidising agents can vary within very wide limits. Generally, they are used in quantities of 0.001 to 10% of the weight of dry cellulosic materials (DS) and most often 0.1 to 5% of the weight of dry cellulosic materials. In the case of peroxide compounds 0.1 to 3% of peroxide compounds calculated as hydrogen peroxide equivalents based on the weight of dry cellulosic materials is generally used. If oxygen is used, the oxygen partial pressure is generally at least 100 kPa and most often at least 300 kPa. Generally, the pressure does not exceed 20,000 kPa and generally does not exceed 10,000 kPa. In the case of compounds capable of liberating active chlorine, these are used in quantities of 0.1 to 8% of the weight of dry cellulosic materials.

Various cellulosic materials can be treated according to the process of the invention. Generally, they are cellulosic materials containing at least 30 and most often at least 50% by wt. of compounds chosen from polysaccharides and derivatives thereof. These include cellulose and hemi-cellulose and derivatives thereof obtained by various chemical treatments such as the acetate process, the viscose process, the cuprammonium process, etc. It is thus possible to apply the process according to the invention to the treatment of pulps of all types such as mechanical pulps, thermomechanical pulps, semi-chemical pulps, chemical chemimechanical pulps and to recovered pulps, at any stage of their production, including the pulping, bleaching stages and the treatments prior to the production of paper sheet or board. It can also be applied to wood or to any particles of wood such as wood shavings. The process is thus suitable for the treatment of wood and wood shavings or other particles of wood intended to be used for the production of pulps such as mechanical pulps, thermomechanical pulps or chemimechanical pulps. It can also be applied to the treatment of cellulosic materials other than wood intended for the production of pulps such as straw, reeds, bagasse and bamboo.

The cellulosic materials according to the invention can also be chosen from natural cellulosic textile fibres such as flax, cotton, hemp, ramie, jute and sisal and synthetic textile fibres such as rayon, viscose rayon, cuprammonium rayon and cellulose acetate and manufactured textiles.

The process according to the invention is particularly suitable for the treatment of pulps and more especially for the treatment of chemical pulps such as suplhate, sulphite or bisulphite pulps. It is also suitable for the treatment of wood particles and more particularly wood shavings, especially for their pretreatment before a mechanical pulping process. Good results have been obtained when treating sulphate pulps, possibly semi-bleached.

The process according to the invention is generally carried out in the presence of a solvent. The solvent is most often water. The quantity of solvent at the beginning of the treatment according to the invention can vary widely. It is most often at least 0.1% and generally does not exceed 99.5% of the total weight of the mixture exposed to the action of microwaves and which essentially comprises the cellulosic materials, the solvent, the oxidising agents and any additives. If the solvent is water, the quantity of water at the beginning of the treatment according to the invention is generally at least 0.5% and most often at least 1% of the total weight of the mixture; generally, it does not exceed 95% and most often it does not exceed 90% and preferably 85% of the total weight of the mixture.

When pulps of any origin, raw pulps or recycled pulps, are being treated, the density at the beginning of the treatment according to the invention is generally at least 5% and most often at least 8%. Generally, it does not exceed 99% and most often it does not exceed 98%.

The process according to the invention can be carried out in the presence of other additives. For example, if the oxidising agent itself is not capable of conferring an appropriate pH on the mixture, compounds of an alkaline nature can be added i.e. those capable of conferring on the water a pH equal to or greater than 7 or compounds of an acid nature i.e. capable of conferring on the water a pH of less than 7, or pH regulators such as buffers. The compounds of an alkaline nature can be hydroxides or carbonates of alkali metals or of ammonium and more particularly sodium hydroxide or sodium silicate. Bicarbonates of alkali metals or of ammonium can be chosen as pH regulators. Sulphuric acid can be chosen as a compound of an acid nature. The process according to the invention is generally carried out in the presence of a compound of an alkaline nature. The quantity of compound of an alkaline nature is generally 0.1 to 20% of the weight of dry cellulosic materials.

If wood shavings are being treated, and if pulps or textile fibres are being bleached, especially with peroxide compounds or compounds capable of liberating active chlorine and preferably with peroxide compounds such as hydrogen peroxide, the pH is generally equal to or greater than 7, more particularly 7 to 13 and most often 8 to 12.

It is also possible to use stabilisers of the oxidising agent if this latter is likely to become deactivated during the treatment. This is the case especially when the oxidising agent is a peroxide compound. Generally, they are used in quantities of 0.01 to 5% of the weight of the dry cellulosic materials.

It is also possible to use various other additives depending on the particular applications. These include sequestering agents, surfactants, agents capable of protecting the cellulosic chains to prevent their being depolymerised, softeners, activators, anti-corrosion agents, anti-static agents, degreasing agents, optical brighteners, dispersants, anti-incrustation agents, foaming agents and wetting agents. These additives are generally used in quantities of 0.01 to 10% of the weight of dry cellulosic materials.

The cellulosic materials undergoing the treatment according to the invention can have very different temperatures before this treatment. Before the treatment according to the invention they can thus have temperatures from ambient temperature i.e. approx. 10° to 25° C. to temperatures of 200° C. Generally, the temperature of the cellulosic materials before the treatment according to the invention depends on whether or not a previous treatment has been carried out. Most often, the temperature of the cellulosic materials before the treatment according to the invention is ambient temperature or that which they have acquired during the preceding treatment, if any. In most cases, the temperature of the cellulosic materials before the treatment according to the invention is 10° to 90° C.

The length of the treatment according to the invention can vary. Generally, it is from 0.1 to 120 minutes and most often from 0.2 to 30 minutes. Generally, it is shorter than that of the corresponding treatments with oxidising agents that do not involve microwaves.

The process according to the invention can be carried out continuously or batchwise.

The exact conditions under which the process according to the invention is carried out and the nature of any other additives used can vary widely depending on the type of cellulosic materials to be treated and the particular purpose of the treatment concerned. Generally, these treatments are carried out by steeping the cellulosic materials in aqueous solutions of oxidising agents or by impregnating them with such solutions.

The process according to the invention can be used in various industries and especially in the paper-making industry and in the textile industry.

Consequently, during the production of mechanical pulps, it is possible to treat according to the process of the invention particles of wood such as shavings using oxidising agents such as peroxide compounds before pulping them in equipment such as refiners. This operation can take place at the same time as or after presteaming. The process according to the invention can also take place after refining or between two refining operations.

The process according to the invention is also suitable for bleaching pulps of all types already formed. It can thus be applied to various bleaching stages following pulping or digestion. It is particularly suitable for treating raw pulps especially alkaline pulps obtained after the washes following digestion mainly in the case of chemical pulps such as kraft pulps, or for treating pulps before they enter the extraction towers. It is also suitable for bleaching semi-bleached pulps.

The process according to the invention is suitable for treating pressed or dried pulps. The pulps can be pressed or dried by means of various kinds of equipment suitable for these uses and known in themselves. It is thus possible to use cylinder presses, screw presses or band presses or conventional dryers or flash dryers. The pulps can take various forms such as sheets or flocks.

The process according to the invention can also be applied to the various treatments with oxidising agents undergone by cellulosic textile fibres. This is the case with scouring, mercerizing, bleaching and impregnation operations such as steaming before aging. These impregnation operations can take place in various types of equipment known in themselves operating either continuously such as pad steamers, J-boxes and U-boxes and continuous pressure steamers, or semi-continuously such as pad-roll machines, or batchwise such as winch backs, autoclaves, reels, jiggers and kiers. The process according to the invention is suitable for pre-treating fibres before they are passed to any one of the treatments mentioned above.

In order to illustrate the invention yet without limiting its scope, some practical examples of execution are given below. Example 2R was carried out by way of comparison. EXAMPLE 1 AND 2R A kraft softwood pulp, semi-bleached according to the CEH sequence with an initial brightness of 63.6° ISO (ISO 2470) was used. The pulp had been fluffed beforehand in a domestic mixer.

The dry pulp was introduced into a polyethylene bag where it was moistened by spraying with an aqueous solution of hydrogen peroxide. It was then exposed to a beam of microwaves with a frequency of approx. 2,450 MHz in a TOSHIBA domestic microwave oven, model ER-649 ET-S with the dial on the "DEFROST" setting for 5 minutes (test 1) or in an oven kept at 100° C. for 5 minutes (test 2R).

The brightness of the pulp was measured with respect to the brightness of $BaSO_4$ measured by means of an ELREPHO (ZEISS)reflectometer fitted with an R 457 filter and a gloss trap (ISO 2470). The hydrogen peroxide consumption was measured by determining the residual hydrogen peroxide in the presence of pulp.

The operating conditions and the results obtained are given in table 1 below.

TABLE I

| Test | 1 | 2R |
|---|---|---|
| $H_2O_2$, g/100 g dry substance | 1.2 | 1.2 |
| pH | 8.5 | 8.5 |
| temperature, °C. | 100 | 100 |
| time, minutes | 5 | 5 |
| density, % | | |
| initial | 81 | 81 |
| final | 95 | 95 |
| brightness °ISO | 70.9 | 66.8 |
| $H_2O_2$ consumption, % | 45 | 1 |

EXAMPLES 3 TO 5

Three tests were carried out at different acid pHs (tests 3 and 4) and at a basic pH (test 5) under conditions similar to those of example 1.

The same semi-bleached pulp as that used to carry out examples 1 and 2R was defibred beforehand in the presence of sulphuric acid (tests 3 and 4) or sodium hydroxide (test 5) so as to adjust the pH to values of 5, 7 and 9 respectively.

The pulp was then centrifuged, fluffed and dried in a ventilated oven at 40° C. The dry pulp was then exposed to the same treatment as in example 1.

The operating conditions and the results obtained are given in table II below.

TABLE II

| Test | 3 | 4 | 5 |
|---|---|---|---|
| $H_2O_2$, g/100 g dry substance | 1.2 | 1.2 | 1.2 |
| pH | 5 | 7 | 9 |
| temperature, °C. | −100 | −100 | −100 |
| time, minutes, | 5 | 5 | 5 |
| density, % | | | |
| initial | 81 | 81 | 81 |
| final | 95 | 95 | 95 |
| brightness °ISO | 70.6 | 72.2 | 72.6 |
| $H_2O_2$ consumption, % | 5 | 29 | 23 |

We claim:

1. A process for the treatment of cellulosic materials with oxidising agents, wherein the cellulosic materials are exposed to the combined action of microwaves and at least one oxidising agent.

2. A process according to claim 1, wherein the oxidising agent is chosen from peroxide compounds, oxygen, ozone, permangante and compounds capable of liberating active chlorine.

3. A process according to claim 2, wherein the oxidising agent is chosen from peroxide compounds.

4. A process according to claim 3, wherein the oxidising agent is chosen from hydrogen peroxide, sodium peroxide, persulphuric acid, sodium persulphate, peracetic acid and sodium peracetate.

5. A process according to claim 4, wherein the oxidising agent is hydrogen peroxide.

6. A process according to claim 1, wherein the oxidising agent is used in quantities of 0.001 to 10% of the weight of dry cellulosic materials.

7. A process according to claim 1, wherein it is carried out in the presence of water.

8. A process according to claim 1, wherein the process is carried out in the presence of 1 to 90% water based on the weight of the mixture containing the cellulosic materials, water, the oxidising agent and any other additives.

9. A process according to claim 1, wherein it is carried out in the presence of a compound of an alkaline nature.

10. A process according to claim 1, wherein the cellulosic materials are chosen from pulps, wood shavings and cellulosic textile fibres.

11. A process according to claim 1, wherein the microwaves have wavelengths from 0.1 to about 100 cm.

* * * * *